United States Patent [19]

Chuan

[11] Patent Number: 4,659,125

[45] Date of Patent: Apr. 21, 1987

[54] HANDLE ROD STRUCTURE OF GOLF RETRIEVER

[76] Inventor: Ching Chuan, No. 281, Chen Te Road, Taipei, Taiwan

[21] Appl. No.: 737,345

[22] Filed: May 23, 1985

[51] Int. Cl.[4] ..... A63B 47/02; B25G 1/04; F16B 7/14

[52] U.S. Cl. ..... 294/19.2; 403/104; 403/351

[58] Field of Search ..... 294/19.1, 19.2, 57; 15/143 B, 144 R, 144 B; 16/115; 403/104, 109, 351, 352

[56] References Cited

U.S. PATENT DOCUMENTS

| | | | |
|---|---|---|---|
| 2,549,257 | 4/1951 | Staunt | 294/19.2 |
| 2,599,222 | 6/1952 | Bergqvist et al. | 403/104 |
| 3,442,544 | 5/1969 | Faber | 294/19.2 |
| 3,515,418 | 6/1970 | Nielsen | 403/109 |
| 3,596,946 | 8/1971 | Burton et al. | 403/109 |
| 3,667,788 | 6/1972 | Greenwood | 403/104 |
| 4,076,437 | 2/1978 | Mazzolla | 403/109 X |
| 4,508,467 | 4/1985 | Choffin | 403/104 |

*Primary Examiner*—Johnny D. Cherry

[57] ABSTRACT

A handle rod structure of a golf ball retriever comprising a plurality of sections of telescopic tubes which can be telescopic in sequence, whereas in each two adjoining tubes, a plunger having an annular groove is provided and inserted into the inner tube. The annular groove forms an eccentric to match the annular sleeve plate which has internal eccentricity the same as that of the annular groove. The annular sleeve plate is placed in the annular groove, so that the rotation of the inner tube in one direction, causes the annular sleeve plate to tightly engage the inner wall of the outer tube, and the rotation of the inner tube in the other direction loosens the annular sleeve plate in the outer tube, thus placing the inner and outer tubes in a state such that they can freely and oppositely extend or retract, thereby achieving the actions of the multi-sectional type and length-adjustable handle rod of the retriever.

6 Claims, 8 Drawing Figures

HANDLE ROD STRUCTURE OF GOLF RETRIEVER

BACKGROUND OF THE INVENTION

The present invention relates to an improvement in the handle rod structure of a golf ball retriever, in particular, the handle structure such that its inner and outer tubes can be rotated in opposite directions and thus mutually packed and secured together. Reversal of such rotation loosens the tubes allowing their retraction and extension. In the use of a golf ball retriever the distances required for a it to reach and retrieve a golf ball are sometimes shorter and sometimes longer. For the convenience of use and carriage, the handle rod of a golf ball retriever is of a multi-sectional type. By means of the telescoping inner and outer tubes, the tubes are telescoped section by section. To alter the length of the golf ball retriever conveniently, sufficient width and looseness between the inner and outer tubes must be provided. Furthermore, both the inner and outer tubes must be optionally fixable according to the distances used under various retractible or extendable states. Further, because the handle rod is of a multi-sectional type, firm securement of the first section is up to the securing force of its second section, which in turn is up to the securing force of its 3rd section and also the mutual securing force of all its following sections. Therefore, the securing structure of its inner and outer tubes is of paramount importance, otherwise, if there happens to occur any movement or rotation of any section, there will result difficulties in any long-distance golf ball retriever operations.

SUMMARY OF THE INVENTION

The main object of this invention is to provide a handle rod structure of a golf ball retriever which includes telescopic multi-sectional inner and outer tubes, plungers, annular grooves and annular sleeve plates. Said plungers are set in the ends of said inner tubes, said annular grooves are cut in said plungers and said annular sleeve plates mounted thereon. By the eccentric principle and rotational movement of said annular sleeve plates and ring-shaped grooves, said inner and outer tubes can optionally and suitably be rotated and secured as well as turned in a reverse direction to release so as to enhance the actions and functions of this multi-sectional type handle rod.

Other objects, features and effects of the present invention will be further understood from the following detailed description with the accompanied drawings.

BRIEF DESCRIPTION OF THE DRAWINGS

FIG. 4-1 is the cross sectional view of line A—A' in FIG. 4.

FIG. 5-1 is the cross sectional view of line B—B in FIG. 5.

DETAILED DESCRIPTION OF THE PRESENT INVENTION

The present invention is composed of a plurality of telescopic tube sections, the tubes can be slid on section by section in sequence, i.e. inside the prime tube A which forms the handle portion there is slid a branch tube B, then said branch B has another branch tube slid therein and so on in sequence. The number of sections of the branch tubes can be determined by the required extensible length, a golf ball retriever F is provided on the end of the tail tube E.

Figure 3:
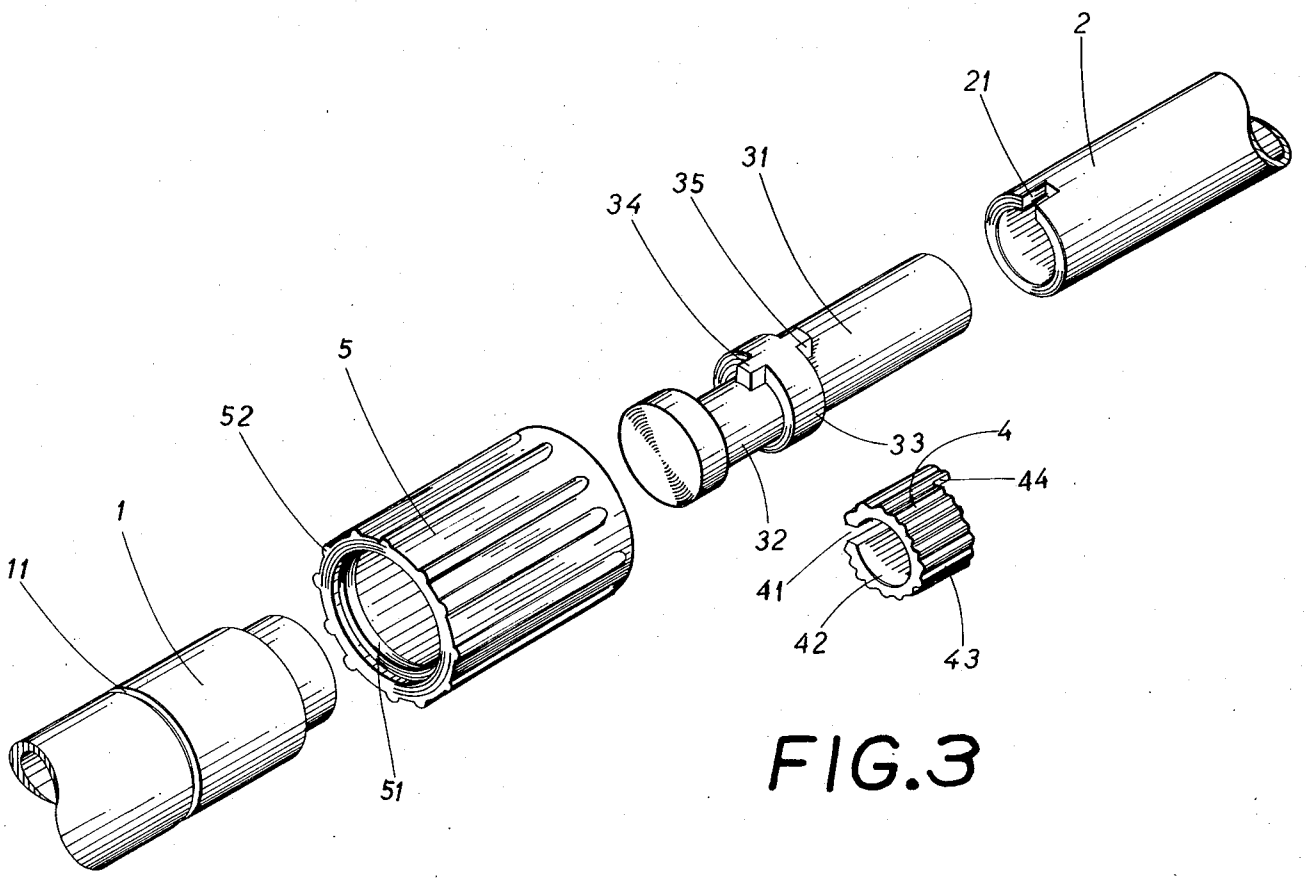
FIG. 3 is an exploded view showing the plunger and annular sleeve plates of the inner and outer tubes of the present invention.

The adjoining outer and inner tubes of the present invention include: a hollow outer tube 1, a hollow inner tube 2, a plunger 3, annular sleeve plate 4, and sectional ring 5. (Please refer to FIG. 3) Outer tube 1 is a hollow round tube, with an annular concave groove 11 provided in the outer rim at a proper position on the front end of outer tube 1. The outer diameter of inner tube 2 is a little smaller than the inner diameter of outer tube 1, such that outer tube 1 can be sleeved on to inner tube 2 from one end of outer tube 1, and cutout notch 21 is provided in the inner end of inner tube 2. Plunger 3 is a cylindrical rod section which has a cylindrical end 31 (the plug-in end), the outer diameter of which is the same as the inner diameter of inner tube 2. The other end of plunger 3 has an eccentric annular groove 32, with a raised ring 33 provided between the annular groove 32 and cylindrical end 31; axial flanges 34, 35 extending toward both ends are provided at a proper place on raised ring 33. Flange 35 is to be inserted in the cutout notch 21 in inner tube 2 to make it drive plunger 3 into rotation when said inner tube 2 is rotated. The annular sleeve plate 4 is a ring-shaped sleeve with an opening 41 and its inner diameter 42 is an eccentric hole with the eccentricity the same as that of above-said annular groove 32. Concave and convex patterns 43 are provided on the outer perimeter of annular sleeve plate 4, and a flange 44 is provided on one end of sleeve plate 4. An annular flange 51 is provided at a proper position in the inner wall of sectional ring 5 (please refer FIGS. 3 and 4), inward from one end, to be inserted into the concave groove 11 of above-said outer tube 1, so as to join the sectional ring 5 onto outer tube 1, while concave and convex patterns 52 are provided on the outer perimeter of sectional ring 5 to permit one to grasp and rotate outer tube 1 easily.

Figure 1:
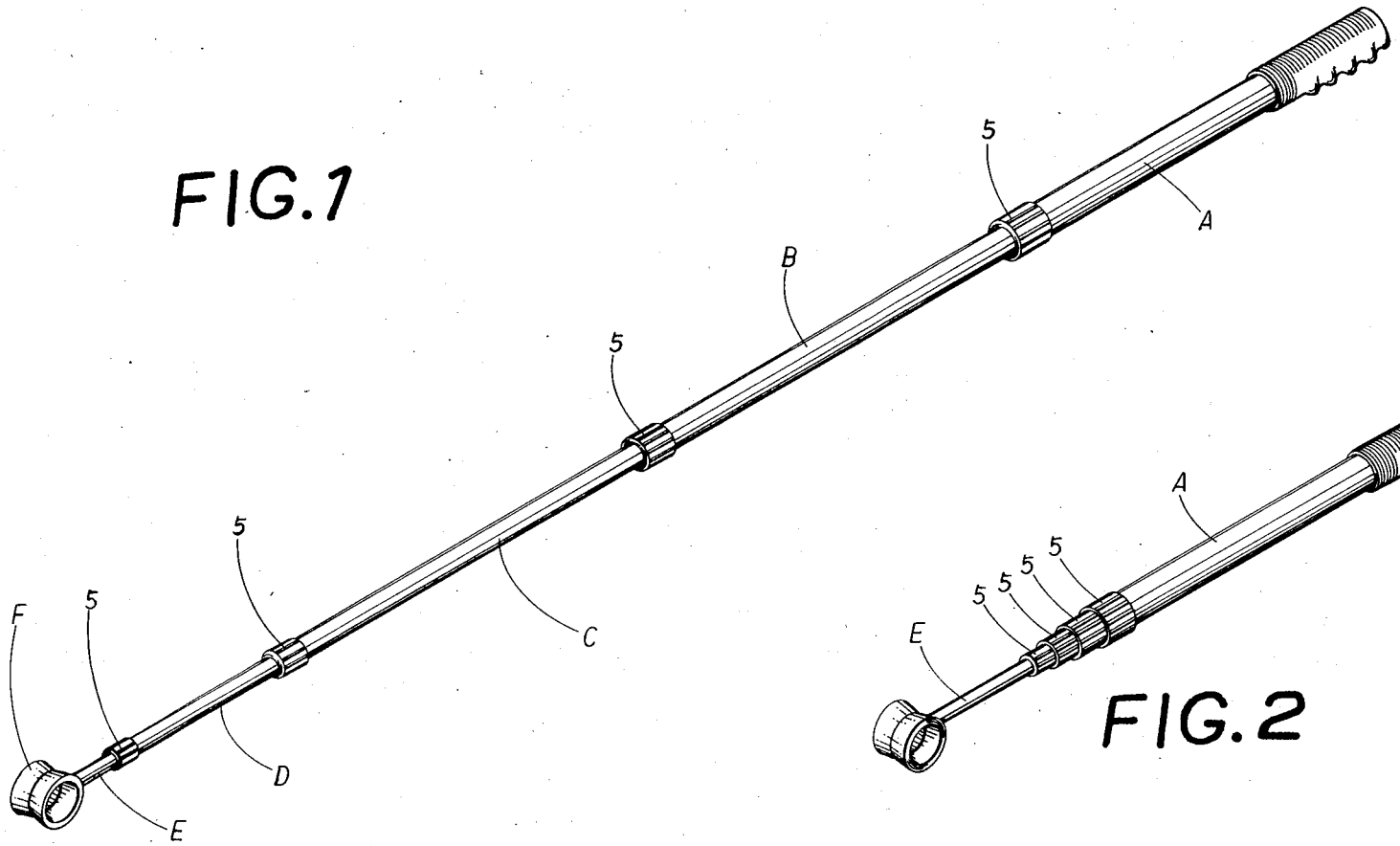
FIG. 1 is a perspective view of the present invention in its extended state.
Figure 2:
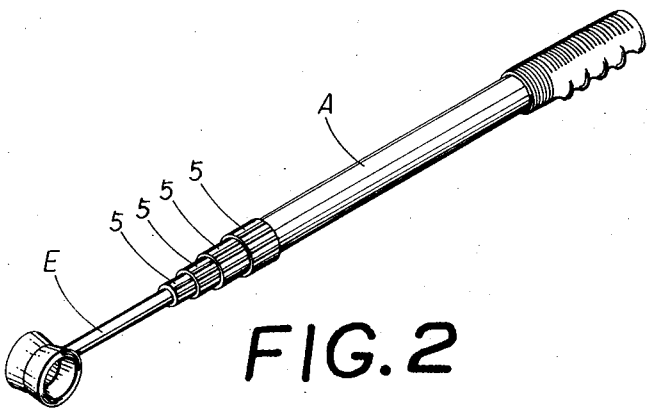
FIG. 2 is a perspective view showing the retracted state of the present invention.
Figure 4:
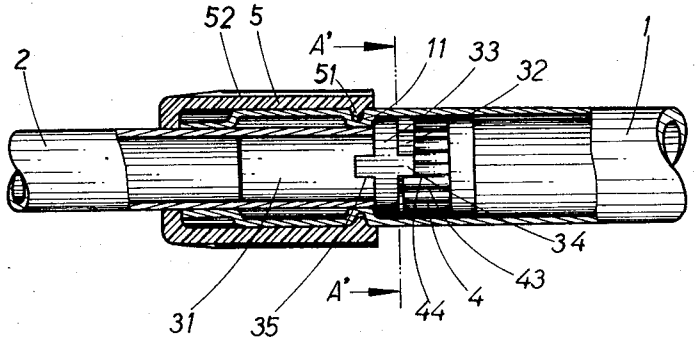
FIG. 4 is a view showing the annular sleeve plate which is set in the annular groove but does not closely engage the inner wall of the inner tube of the present invention.
Figures 1, 4:
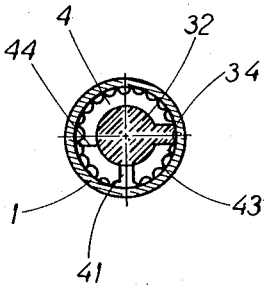
Figure 5:
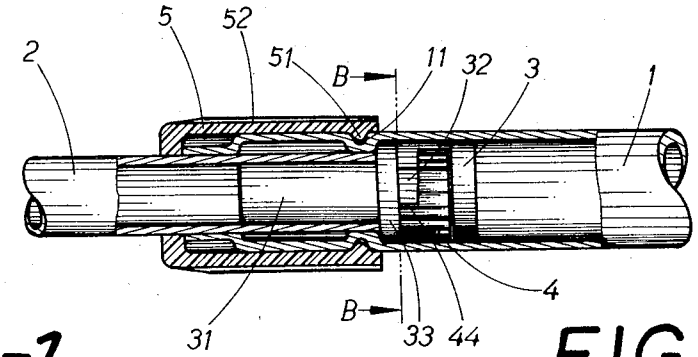
FIG. 5 is a view showing the annular sleeve plate set in the annular groove and also closely engaging the inner wall of the inner tube of the present invention.
Figures 1, 5:
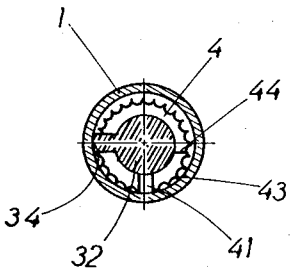
Figure 6:
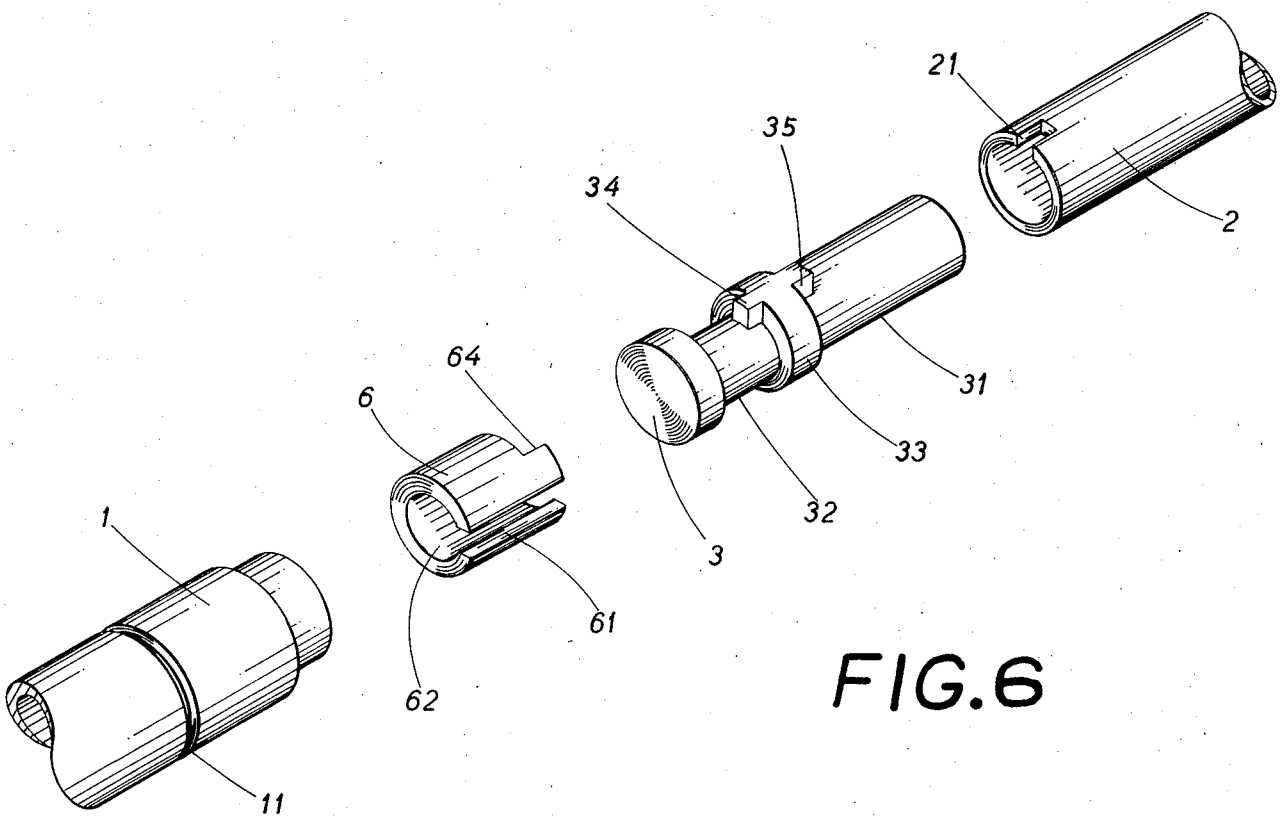
FIG. 6 is another embodiment showing annular sleeve plates of the present invention.

In use, because the eccentricity of the above-said annular groove 32 is the same as that of the inner diameter of annular sleeve plate 4, when inner tube 2 is rotated toward one direction, the flange 34 of plunger 3 engages the flange 44 of annular sleeve plate 4, thus rotating them together at the same time. The plunger 3 and the outer perimeter of annular sleeve plate 4 form a concentric circle (without any eccentric phenomenon), and the inner and outer tubes are in a loose state as shown in FIGS. 4 and 4-1. Thus, inner and outer tubes are extendable and retractable to adjust their lengths. When inner tube 2 is rotated in the opposite direction, the flange 34 of plunger 3 disengages the flange 44 of annular sleeve plate 4, thus gradually forming the eccentric phenomenon, and also gradually making annular sleeve plate 4 tightly engage the inner wall of outer tube 1 (as shown in FIGS. 5 and 5-1. If rotated in the reverse way, just as mentioned above, inner and outer tubes will restore to their original loose state so as to be adjustable. The above-said is one embodiment of the present invention, according to the structure comprising the plunger, annular groove, and annular sleeve plate provided in this case, their concrete shapes may still have local changes and modifications without departing in a substantial way from the above structure. For instance, the annular sleeve plate in this case can have a smooth surface is the case with the annular sleeve plate 6 in FIG. 6 wherein opening 61, inner diameter 62 and flange 64 correspond to items 41,42 and 44 respectively of annular sleeve plate 4 of FIG. 3.

Summing up, as to the handle rod structure of the golf ball retriever provided by the present invention, the retrieving and securing state between its inner and outer tubes is extremely precise such that it cannot easily be turned loose, especially in the generally used items such as the 4–6-section golf ball retriever handle rod. The securing between the various sections affects the similar state of the other sections; besides, as for the structure provided by the present invention, its members are simple and easy to operate, so it has a high practical value.

I claim:

1. A handle rod structure for a golf ball retriever comprising a hollow outer tube, a hollow inner tube, a plunger, an annular sleeve plate and a sectional ring, wherein said inner tube is telescopic with said outer tube and accepts one end of said plunger, the other end of said plunger, together with said inner tube, being slideable within said outer tube; said other end of said plunger further having an annular eccentric groove therein in which said annular sleeve plate fits, said annular sleeve plate having an eccentric inner diameter cooperating with said eccentric groove upon rotation of the inner tube and plunger combination so as to be urged into and out of engagement with the inside of said outer hollow tube, said sectional ring overlying the end of said outer tube.

2. The handle rod structure according to claim 1, wherein said outer tube has an annular concave groove a short distance from its end and said sectional ring has an annular flange inside one end, said groove and said flange cooperating to hold said sectional ring onto said outer tube so as to be rotatable therewith.

3. A handle rod structure of claim 1, wherein said inner tube has a notch in its inner end and said plunger has a raised ring between said eccentric groove and the end accepted in said inner tube, said ring having an axial flange extending towards said end, said flange being inserting into said notch to secure said plunger in said inner tube so as to be rotatable therewith.

4. The handle rod structure of claim 3, wherein said raised ring has a second axial flange extending opposite said first axial flange and into said annular eccentric groove and engaging said annular sleeve plate to rotate said annular sleeve plate out of engagement with the inside of said outer tube.

5. The handle rod structure of claim 4, wherein said annular sleeve plate has a smooth outer surface.

6. The handle rod structure of claim 4, wherein said annular sleeve plate has an outer surface provided with concave and convex patterning.

* * * * *

UNITED STATES PATENT AND TRADEMARK OFFICE

CERTIFICATE OF CORRECTION

PATENT NO. : 4,659,125

DATED : April 21, 1987

INVENTOR(S) : Ching Chuan Lee

It is certified that error appears in the above-identified patent and that said Letters Patent is hereby corrected as shown below:

Cover page, after "Inventor," change "Ching Chuan" to --Ching Chuan Lee--.

Cover page, under Item (19) "Chuan" should read --Chuan Lee--.

Signed and Sealed this

Fifteenth Day of August, 1989

*Attest:*

DONALD J. QUIGG

*Attesting Officer*

*Commissioner of Patents and Trademarks*